United States Patent [19]

Nozawa

[11] 4,256,593

[45] Mar. 17, 1981

[54] REFRIGERATING MACHINE OIL

[75] Inventor: Kenji Nozawa, Osaka, Japan

[73] Assignee: Matsushita Reiki Co., Ltd., Osaka, Japan

[21] Appl. No.: 67,763

[22] Filed: Aug. 17, 1979

[30] Foreign Application Priority Data

Aug. 18, 1978 [JP] Japan ..... 53/101227

[51] Int. Cl.[3] ..... C10M 1/00; C10M 1/46

[52] U.S. Cl. ..... 252/49.8; 208/18

[58] Field of Search ..... 208/14, 18; 252/49.8, 252/68

[56] References Cited

U.S. PATENT DOCUMENTS 3,129,185 4/1964 Rizzuti et al. ..... 252/68

3,145,161 8/1964 Anderson et al. ..... 208/14

*Primary Examiner*—Herbert Levine

*Attorney, Agent, or Firm*—Wenderoth, Lind & Ponack

[57] ABSTRACT

Refrigerating machine oil to be filled in a sealed motor-compressor unit constituting a refrigerating cycle system including an electric refrigerator, an electric cold-storage box, a small-scaled electric refrigerating show-case, a small-scaled electric cold-storage show-case and the like, is arranged to have a specifically enhanced property, in which smaller initial driving power consumption of the sealed motor-compressor and easier supply of the predetermined amount of the refrigerating machine oil to the refrigerating system are both guaranteed even in a rather low environmental temperature condition.

2 Claims, 3 Drawing Figures

REFRIGERATING MACHINE OIL

BACKGROUND OF THE INVENTION

This invention relates to a sealed motor-compressor unit for refrigeration systems, or more particularly, to a refrigerating machine oil to be supplied for the compressor composing the sealed motor-compressor unit mentioned above.

Conventionally, as far as a refrigerating machine oil to be supplied for the compressor composing the sealed motor-compressor unit constituting a refrigerating cycle is concerned, refrigerating machine oil of ISO-VG 32 grade (more specifically, International Organization for Standardization VG 32 grade), the kinetic viscosity of which is defined to be 27 to 35 centistokes, has been employed for use in common.

However, in the case of the sealed motor-compressor provided with the power rating less than one horse power, the power rating of the motor included in the sealed motor-compressor is not sufficient to fully cope with variations in loads to be often effected in connection, for example, with the unsteady operation. Therefore, under these circumstances as described above, as long as such the refrigerating machine oil of ISO-VG 32 grade having a relatively high kinetic viscosity and thus, providing a rather high oil film or shearing resistance at an ordinary lubricating process, is to be employed, the faulty actuation concerning the sealed motor-compressor will not be avoidable. As a matter of fact, the disadvantages as described above may be especially frequently encountered under a rather low temperature condition, subject to the fact that the initial working load caused by the oil film shearing resistance will be increased in association with the decrease of the environmental temperature. Furthermore, if the machine oil mentioned above has a much higher viscosity due to the reasons as described above, the amount of machine oil to be fed tends to be decreased and thus, the occurrence of undesirable friction loss to be involved in respective sliding portions of the compressor composing the sealed motor-compressor unit has not been avoided.

Accordingly, a refrigerating machine oil especially suitable for use in a sealed motor-compressor unit, particularly constituting a refrigerating cycle and is provided with a motor not having a sufficient reverse capacity in the electric rating against variations in loads, has been strongly demanded.

SUMMARY OF THE INVENTION

Accordingly, an essential object of the present invention is to provide a refrigerating machine oil, which is capable of reducing initial actuating torque required during starting of a sealed motor-compressor unit, and also power consumption during the steady operation of the sealed motor-compressor unit.

Another important object of the present invention is to provide a refrigerating machine oil of above-described type, which ensures a positive starting and steady operation of the sealed motor-compressor unit, irrespective of environmental temperature changes and/or variations of electric voltage impressed to the sealed motor-compressor unit.

A further object of the present invention is to provide a refrigerating machine oil of the above-described type, which is capable of preventing the occurrence of wear or abrasion of respective sliding portions constituting the sealed motor-compressor unit, thereby to keep the sealed motor-compressor in an ordinary operating condition.

A still further object of the present invention is to provide a refrigerating machine oil of the above-described type, which is arranged to include an appropriate amount of phosphate extreme pressure additive, so that the lubricating characteristics are to be enhanced and, thus resulting in a lower electric power consumption.

In accomplishing these and other objects according to one preferred embodiment of the present invention, there is provided a refrigerating machine oil comprising low volatile distillates of naphthenic type oil. The naphthenic type oil mentioned above consists of aromatic carbon $C_A$ having a range of 5 to 15 wt%, paraffinic carbon $C_P$ having a range of 35 to 45 wt%, and naphthenic carbon $C_N$ having a range of 45 to 55 wt%. The refrigerating machine oil mentioned above is arranged to have a specific physical property of a comparatively low kinetic viscosity, which is specified by respective kinetic viscosity ranges of 7.0 to 13.0 cst. at 100° F. and 2.0 to 2.5 cst. at 210° F., respectively, with seizure load of more than 450 lbs in respect to the falex test being also confirmed. According to one example of the present invention, the above-mentioned low volatile distillates or more specifically, the refrigerating machine oil was specified to that having an initial boiling point of 281° C. and an end point of 387° C. under an atomospheric pressure condition, which was confirmed by experiments with a method as indicated by ASTM D-1160. Furthermore, a pour point of the refrigerating machine oil mentioned above is below a temperature of −45 ° C., while its flock point is confirmed to be below a temperature of −35° C. Due to the specific properties as mentioned above, according to the present invention, besides the fact a shearing resistance relating to the respective sliding portions of the compressor is much decreased, it becomes clear that the present refrigerating machine oil itself is characterized in its enhanced fluidity.

Furthermore, in order to further enhance the lubricating property, the above-mentioned refrigerating machine oil is further added with phosphate extreme pressure additive including tricyresyl phosphate and triphenyl phospate of 0.1 to 2.0 by weight precent. Consequently, the resultant refrigerating machine oil substantially makes it possible not only to allow the present refrigerating machine oil to be effectively untilized under any undersirable electric supply conditions, but also to appreciably reduce the electric consumption required for driving the sealed motor-compressor unit.

BRIEF DESCRIPTION OF THE DRAWINGS

These and other object and features of the present invention will become apparent from the following description taken in conjunction with the preferred embodiment thereof with reference to the accompanying drawings in which.

DETAILED DESCRIPTION OF THE INVENTION

In the following, one of the preferred embodiments of refrigerating machine oils, which is suitable for use in a motor constituting a sealed motor-compressor unit, according to the present invention, is to be disclosed. According to the present invention, there is provided a refrigerating machine oil, which is mainly constituted by a low volatile distillates of naphthenic type oil. The naphthenic type oil mentioned above consists of aromatic carbon $C_A$ having a range of 5 to 15 wt%, paraffinic carbon $C_P$ having a range of 35 to 45 wt%, and naphthenic carbon $C_N$ having a range of 45 to 55 wt%. The refrigerating machine oil mentioned above is arranged to have a specific physical property of a comparatively low kinetic viscosity, which is specified by respective kinetic viscosity ranges of 7.0 to 13.0 cst. at 100° F. and 2.0 to 2.5 cst. at 210° F. According to one example of the present invention, the above-mentioned low volatile distillates or more specifically, the refrigerating machine oil was specified to that having an initial boiling point of 281° C. and an end point of 387° C. under an atmospheric pressure condition, which was confirmed by experiments with a method as indicated by ASTM D-1160. Owing to the low viscosity arrangement as described above, a shearing resistance to be involved is to be much decreased accordingly, whereby the power input necessary fo the refrigerating compressor filled by the refrigerating machine oil according to the present invention is in turn decreased and thus, substantially resulting in an economical reduction in an electrical power consumption accordingly. Moreover, since the occurrence of the undesirable frictional loss and its consequent production of frictional heat are maintained as low as possible due to the specifically low kinetic viscosity of the oil according to the present invention, the refrigerating compressor is not subjected to overheating and thus, a sufficiently long life span of the compressor is expected.

Figure 1:
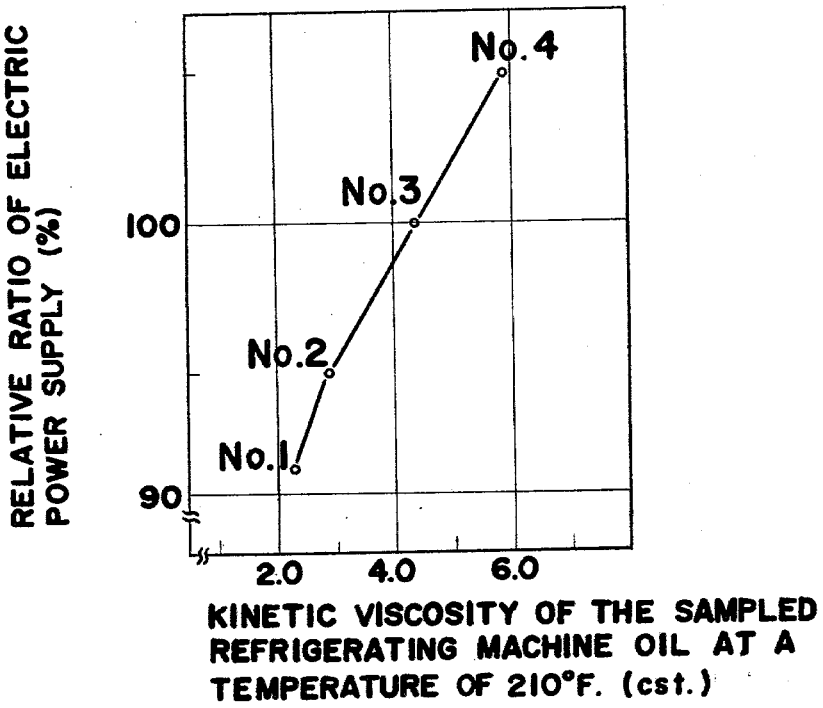
FIG. 1 is a graph, particularly showing a correlation plotting a relative ratio (%) of electric power supply required for a compressor in the course of steady operation of an ordinary electric refrigerating system against a kinetic viscosity (cst.) of the sampled refrigerating machine oil at a temperature of 210° F.

Referring now to FIG. 1, there is shown a correlation, wherein the electric power supply required for the compressor in the course of steady operation of an ordinary electric refrigerating apparatus is plotted against the sampled specific kinetic viscosity (cst.) of the refrigerating machine oil employed for lublication of the compressor. In FIG. 1, the electric power supply mentioned above taken as the ordinate is represented by the relative ratio (%) with respect to that required when the conventional refrigerating machine oil is employed. However, the abscissa of the correlation mentioned above is respective kinetic viscosities of several refrigerating machine oils to be given at a temperature of 210° F. More specifically, the respective kinetic viscosities of the refrigerating machine oils employed for the above-mentioned correlation, i.e., Sample No. 1 to Sample No. 4 are listed in Table 1, with the respective kinetic viscosities to be given at a temperature of 100° F. being also listed. In Table 1, one embodiment of the refrigerating machine oil according to the present invention is denoted by No. 1, while the typical, conventional refrigerating machine oil is denoted by No. 3. The respective refrigerating machine oils denoted by No. 2 and No. 4 are both specifically composed for reference, when two refrigerating machine oils mentioned above are compared with respect to each other. As described hereinabove, in FIG. 1, the respective ratio mentioned above is, therefore, the relative value with respect to that required and referenced by the value of 100 for the employment of the conventional refrigerating machine oil denoted in No. 1.

As is clear from FIG. 1, the correlation of relative electric power supply for the compressor shows a decreasing tendency in accordance with the decrease of the specific value of kinetic viscosity of the refrigerating machine oil employed, whereby the electric power to be consumed by the sealed motor-compressor unit is capable of being effectively decreased, subject to an employment of the appropriate refrigerating machine oil accordingly.

TABLE 1

| Sample number | Viscosity of refrigerating machine oil (cst.) 100° F. | 210° F. |
|---|---|---|
| No. 1 | 9.60 | 2.35 |
| No. 2 | 14.51 | 2.94 |
| No. 3 | 33.40 | 4.43 |
| No. 4 | 62.00 | 5.90 |

Figure 2:
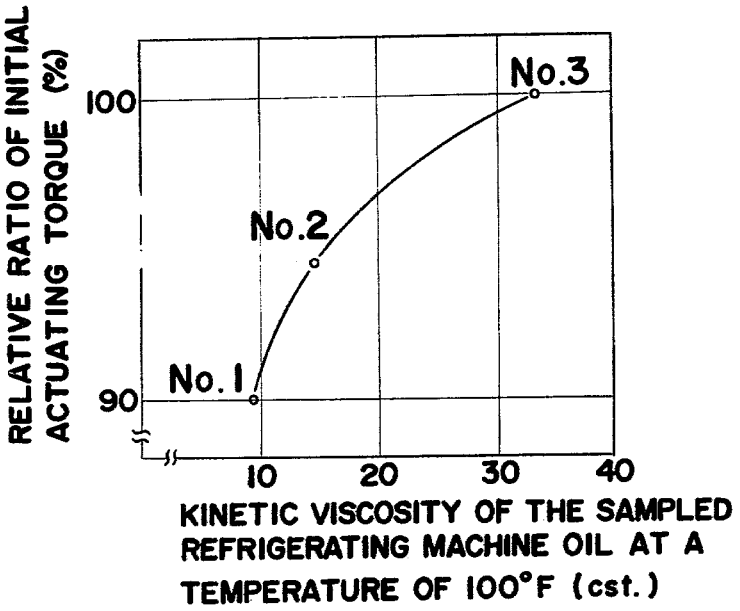
FIG. 2 is a graph, particularly showing a correlation plotting a relative ratio (%) of initial actuating torque required for driving the compressor constituting the ordinary electric refrigerating system against a kinetic viscosity (cst.) of the sampled refrigerating machine oil at a temperature of 100° F.

Referring now to FIG. 2, there is shown a correlation, wherein a relative ratio (%) of initial actuating torque required for driving the compressor constituting the sealed motor-compressor unit is plotted against the sampled specific kinetic viscosity (cst.) of the refrigerating machine oil employed for lubrication of the compressor at a temperature of 100° F. Respective kinetic viscosities of sampled refrigerating machine oils, which are respectively denoted by No. 1 to No. 3 in FIG. 2, are listed in Table 2. The sample denoted by No. 1 is the refrigerating machine oil according to the present invention, while the sample denoted by No. 3 is the conventional one. The sample denoted by No. 2 is specifically composed one for reference, when two refrigerating machine oils mentioned above are compared with respect to each other. More specifically, FIG. 2 showns the correlation, wherein the relative, initial actuating torque (%) for driving the compressor, with that to be effected with the sample denoted by No. 3 being chosen as a reference value of 100, is plotted against the specific kinetic viscosity of the sampled refrigerating oil at a temperature of 100° F., respectively. As is clear from FIG. 2, the initial actuating torque driving the compressor is capable of being effectively decreased, subject to the employment of the refrigating machine oil specifically having a relative, low kinetic viscosity according to the present invention, whereby a comparatively easy actuation of the compressor is to be effected by impressing the relative low electric voltage thereonto in comparison with the case of the employment of the conventional refrigerating machine oil.

TABLE 2

| Sample number | Viscosity of refrigerating machine oil (cst.) 100° F. | 210° F. |
|---|---|---|
| No. 1 | 9.60 | 2.35 |
| No. 2 | 14.51 | 2.93 |
| No. 3 | 33.40 | 4.43 |

Figure 3:
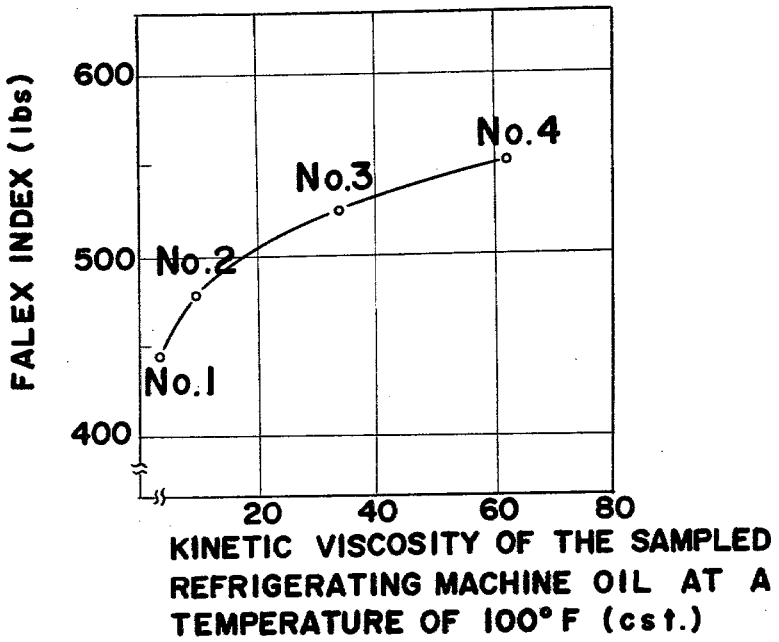
FIG. 3 is a graph, particularly showing a correlation plotting a falex index against a kinetic viscosity (cst.) of the sampled refrigerating machine oil at a temperature of 100° F.

The refrigerating machine oil specifically having a relative, low kinetic viscosity according to the present invention has the specific properties as follows. That is to say, a pour point of the refrigerating machine oil mentioned above is below a temperature of −45° C., while its flock point is below a temperature of −35° C. Due to the characteristic properties as described above, since the present oil will not be left in a stagnant state within the explorator consisting the electric refrigerating system, such as the electric refrigerator, electric cold-storage box or electric refrigerating- or electric cold-storage-show case, the occurrence of oil-choking phenomemon is to be prevented, which often affects the refrigerating capacity in an undesirable manner. Accordingly, the refrigerating machine oil according to the present invention is quite suitable for the refrigerating machine oil to be employed for the sealed motor-compressor unit. Furthermore, according to the falex test, which was conducted as one step of the present invention for confirming the lubricating characteristics of the present refrigerating machie oil, it is confirmed that seizure affecting the lubricating portion of the compressor was, in general effeced at the seizure load less tha 450 in and ordinary expermental condition, However, according to the falex test with the refrigerating machine oil of the present invention, the occurance of seizure mentioned above was not confirmed below the seizure load of 480 lbs. Accordingly, it is clear that the refregerating machine oil according to the present invention does not involve any substantial defects related to mechanical friction and seizure. Referring now to FIG. 3, there is shown a correlation, wherein the seizure load or, more specifically, the falex index is plotted against the kinetic viscosity given by the sampled refrigerating machine oil of mineral nature at the temperature of 100° F. The respective kinetic viscosities given by the respective sampled refrigerating machine oil at respective temperatures of 100° F. and 210° F. are listed in Table 3. In Table 3, the sample denoted by No. 2 is the refrigerating machine oil according to the present invention, while the sample denoted by No. 3 is the conventional one. The respective samples denoted by No. 1 and No. 4 are both specifically composed with reference, when two refrigerating machine oils mentioned above are compared with respect to each other. The falex tests were made in the temperature conditions of a room temperature. Accordingly, the respective temperatures of the refrigerating machine oils employed for experiments were first at the temperature of 25° C., whereas these were increased by more or less ten degrees in the course of the seizuring test.

TABLE 3

| Sample number | Viscosity of refrigerating machine oil (cst.) | |
|---|---|---|
| | 100° F. | 210° F. |
| No. 1 | 4.10 | 1.40 |
| No. 2 | 9.60 | 2.35 |
| No. 3 | 33.40 | 4.43 |
| No. 4 | 62.00 | 5.90 |

In the case wherein the improved lubrication of the large-scaled compressor provided with the lower rating more than one horse power is desired, the lubricating property inherent in the above-mentioned refrigerating machine oil according to the present invention is to be enhanced by adding prosphate extreme pressure additive of 0.1 to 2.0 by weight percent, such as tricyresyl phosphate or triphenyl phosphite.

Consequently, as the refrigerating machine oil according to the present invention is further added with phosphate extreme pressure additive of 0.1 to 2.0 by weight percent, such as tricyresyl phosphate or triphenyl phosphite, the resultant refrigerating machine oil substantially makes it possible not only to allow the present refrigerating machine oil to be effectively utilized for the compressor having a power rating more than one horse power, but also to reduce the electric consumption required for driving the sealed motor-compressor unit.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A refrigerating machine oil comprising low volatile distillates of naphthenic type oil, in which the kinetic viscosity is within 7.0 to 13.0 cst. at a temperature of 100° F. and, within 2.0 to 2.5 cts. at a temperature of 210° F., respectively, with a seizure load of more than 450 lbs in respect to the falex test said refrigerating machine oil having a pour point below −45° F. and a flock point below −35° F.

2. A refrigerating machine oil as claimed in claim 1, wherein said refrigerating machine oil further comprises a phosphate extreme pressure additive including tricyresyl phosphate and triphenyl phosphate of 0.1 to 2.0 by weight percent.

* * * * *